United States Patent [19]

Morningstar et al.

[11] Patent Number: 4,787,866

[45] Date of Patent: Nov. 29, 1988

[54] CONNECTOR FOR UNLOCKING CONDUCTIVE MEMBERS FROM CONDUCTIVE PINS

[75] Inventors: Leroy J. Morningstar, Middletown; Charles I. Tighe, Jr., Hershey, both of Pa.

[73] Assignee: AMP Incorporated, Harrisburg, Pa.

[21] Appl. No.: 181,360

[22] Filed: Apr. 14, 1988

[51] Int. Cl.[4] ..... H01R 13/62

[52] U.S. Cl. ..... 439/268; 439/266

[58] Field of Search ..... 439/266–270

[56] References Cited

U.S. PATENT DOCUMENTS

| | | | |
|---|---|---|---|
| 3,705,376 | 12/1972 | Kinkaid et al. | 439/161 |
| 3,796,987 | 3/1974 | Kinkaid et al. | 439/748 |
| 3,818,569 | 6/1974 | Kinkaid et al. | 29/203 H |
| 4,067,633 | 1/1978 | Groft et al. | 439/268 |
| 4,407,558 | 10/1983 | Thrift | 439/268 |
| 4,466,687 | 8/1984 | Frantz | 439/395 |
| 4,556,275 | 12/1985 | Hamsher, Jr. | 439/266 |

OTHER PUBLICATIONS

IS7676–released 4/28/74–2 pages, AMP Incorporated.
IS CI 8050–91, released 4/9/84–2 pages, AMP Incorporated.

*Primary Examiner*—Gary F. Paumen
*Attorney, Agent, or Firm*—Gerald K. Kita

[57] ABSTRACT

An electrical connector comprising; locking members 32,32 constructed for locking to conductive pins 27,27 projecting from a printed circuit board 28, a moveable housing 35 for movement against the locking members 32,32 to deflect the locking members 32,32 to unlock them from the pins 27,27, an insulative housing 2 containing the conductive locking members 32,32 and electrical contacts 4,4 in the insulative housing 2 for unlocked connection to corresponding conductive pins 27,27, and the moveable housing 35 is mounted for axial movement within the insulative housing 2.

4 Claims, 6 Drawing Sheets

CONNECTOR FOR UNLOCKING CONDUCTIVE MEMBERS FROM CONDUCTIVE PINS

FIELD OF THE INVENTION

The invention relates to an electrical connector for unlocking conductive members from conductive pins projecting from a printed circuit board, known as a PCB.

BACKGROUND OF THE INVENTION

There is disclosed in U.S. Pat. No. 4,067,633 an electrical connector comprising; conductive locking members constructed for locking to conductive pins projecting from a printed circuit board, an insulative housing containing the conductive members and an insulative moveable housing for movement with respect to the first housing and for movement against the locking members to deflect the locking members to unlock them from the pins.

Conductive pins are used in large numbers on a PCB and are closely spaced apart from one another on the PCB. In the known connector described in the patent, all of the electrical contacts are deflected by a movable housing, the movable housing is required to extend laterally to engage all of the contacts, and thereby a relatively wide connector results.

In the known connector described in the patent, all of the electrical contacts, including electrical contacts for unlocked connection to corresponding conductive pins, are deflected by a movable housing, the movable housing is required to extend laterally to engage all of the contacts, and thereby a relatively wide connector results.

SUMMARY OF THE INVENTION

An electrical connector according to the invention has a first housing containing electrical contacts for unlocked connection to corresponding pins of a printed circuit board, and a movable housing for deflecting locking members to unlock them from conductive pins, the locking members are mounted in the movable housing, and the movable housing is mounted for movement within the first housing, such that an economy of space results which permits the first housing and the electrical contacts and the locking members to fit among a plurality of like connectors for connection to closely spaced apart pins on a printed circuit board.

The known connector disclosed in the patent is relatively wide because the movable housing projects outward laterally of the first housing and exterior handles of the movable housing also project outward laterally of the first housing. A relatively wide connector is impractical for fitting among a plurality of like connectors for connection to closely spaced apart pins.

An electrical connector as in the present invention has a movable housing for deflecting locking members to unlock them from conductive pins, the locking members are mounted in the movable housing and the movable housing is mounted for axial movement within an insulative housing, electrical contacts are in the insulative housing for unlocked connection to corresponding conductive pins and sides of the insulative housing encircle the movable housing and is for fitting among a plurality of like connectors for connection to closely spaced apart pins projecting from a printed circuit board.

The present invention will now be described, by way of example with reference to the drawings.

Figure 1:
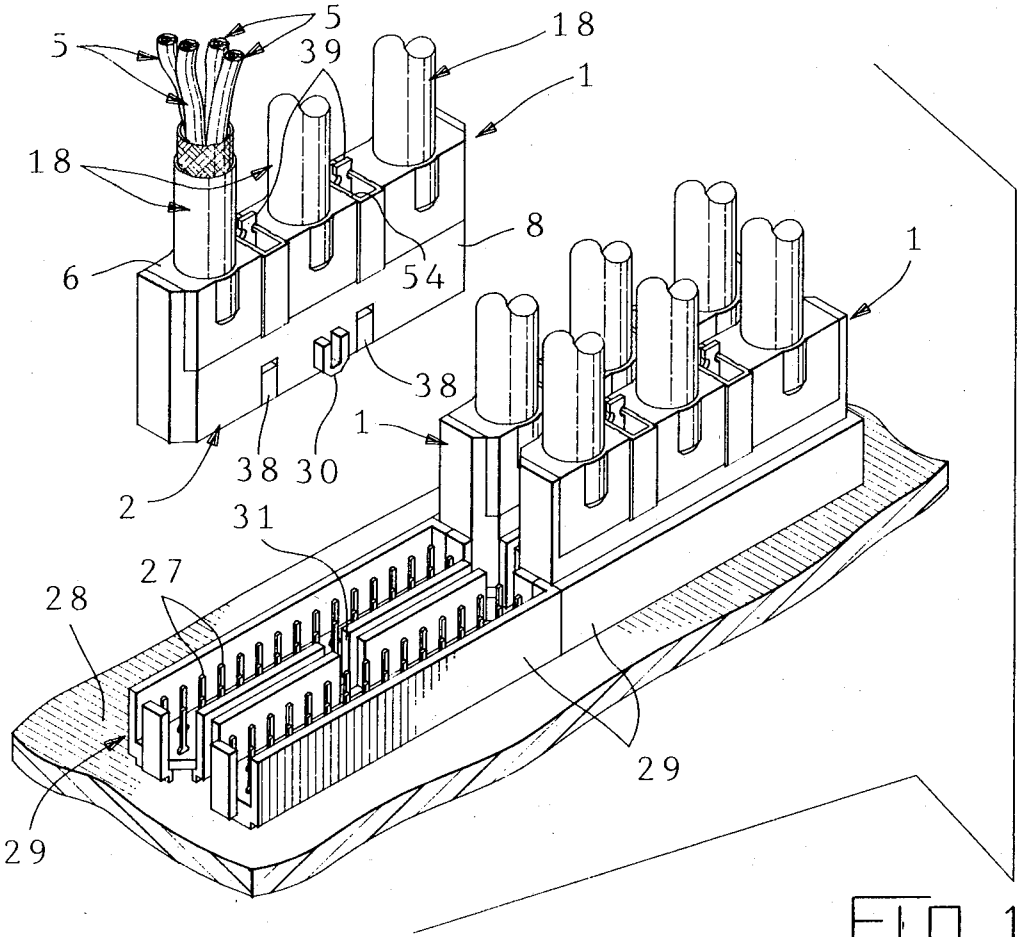
FIG. 1 is a fragmentary perspective view of a cable assembly having an electrical connector fitting among a plurality of like connectors for connection to closely spaced apart pins on a printed circuit board.
Figure 2:
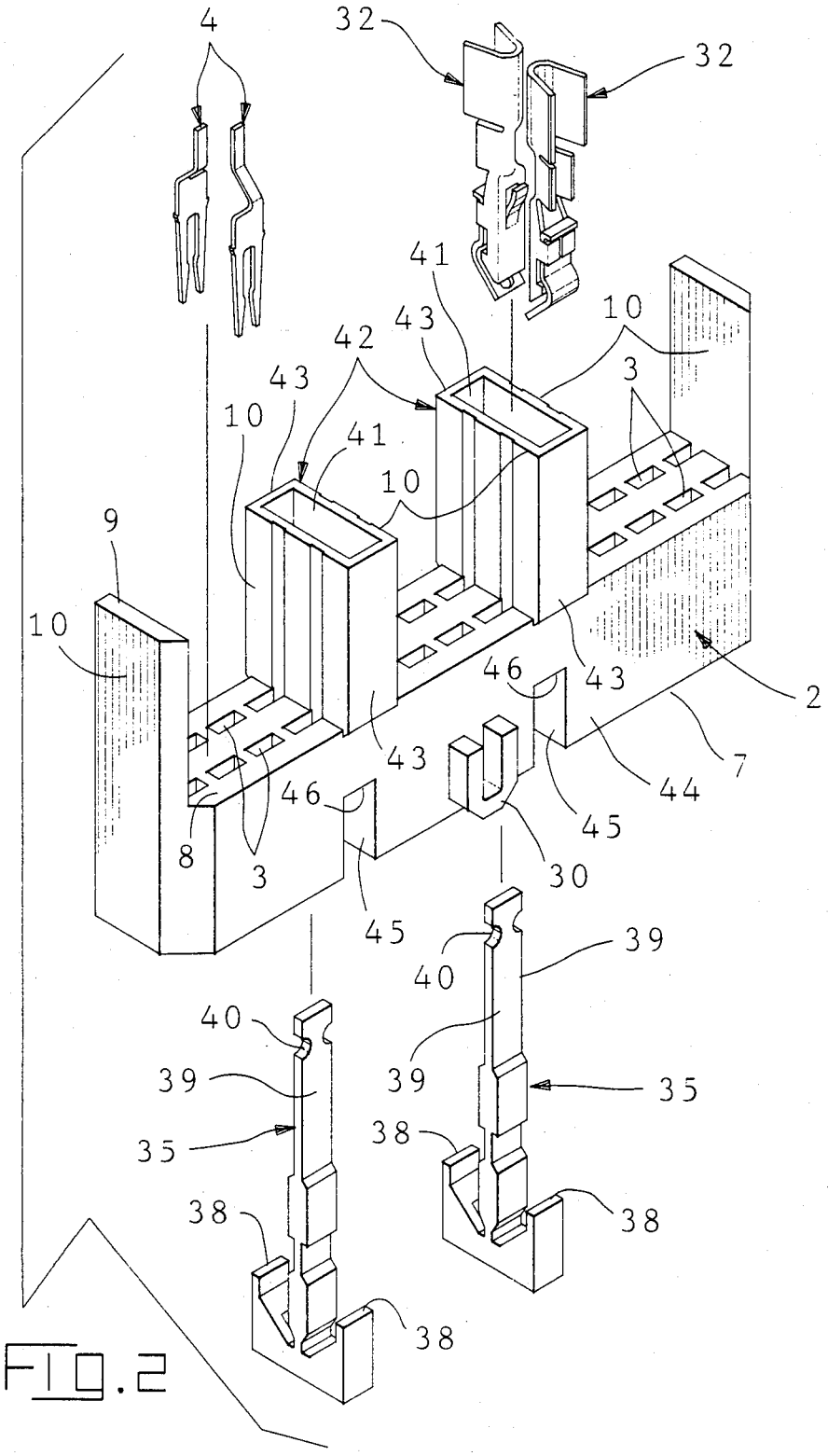
FIG. 2 is a fragmentary perspective view of the cable assembly shown in FIG. 1 with parts of the connector illustrated in exploded configuration.

With more particular reference to the drawings there is shown in FIGS. 1 and 2 an electrical connector 1 including a rigid insulative housing 2 having axially extending contact receiving cavities 3,3, conductive electrical contacts 4,4 in corresponding cavities 3,3 coaxial conductors 5,5 connected with corresponding contacts 4,4 and a mass 6 of insulative material.

As shown in FIG. 2, the housing 2 is of unitary construction with a front end 7 defined by a block 8, and a rear end 9 provided by axially extending, rear walls 10,10. The contact receiving cavities 3,3 extend axially through the block 8.

Figure 3:
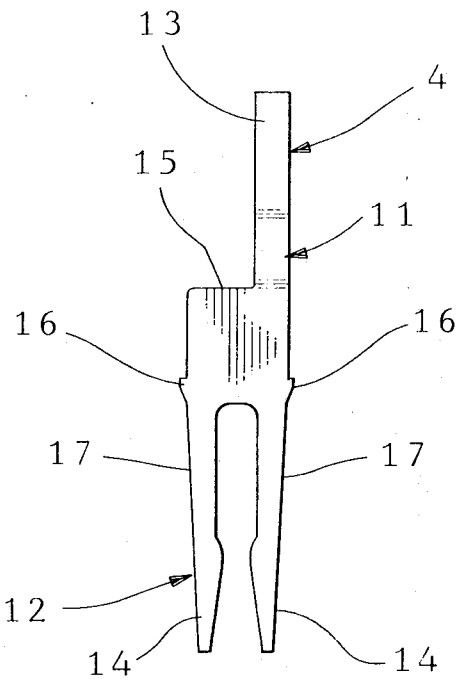
FIG. 3 is an enlarged elevation view of an electrical contact of the cable assembly shown in FIG. 1.
Figures 4, 4A:
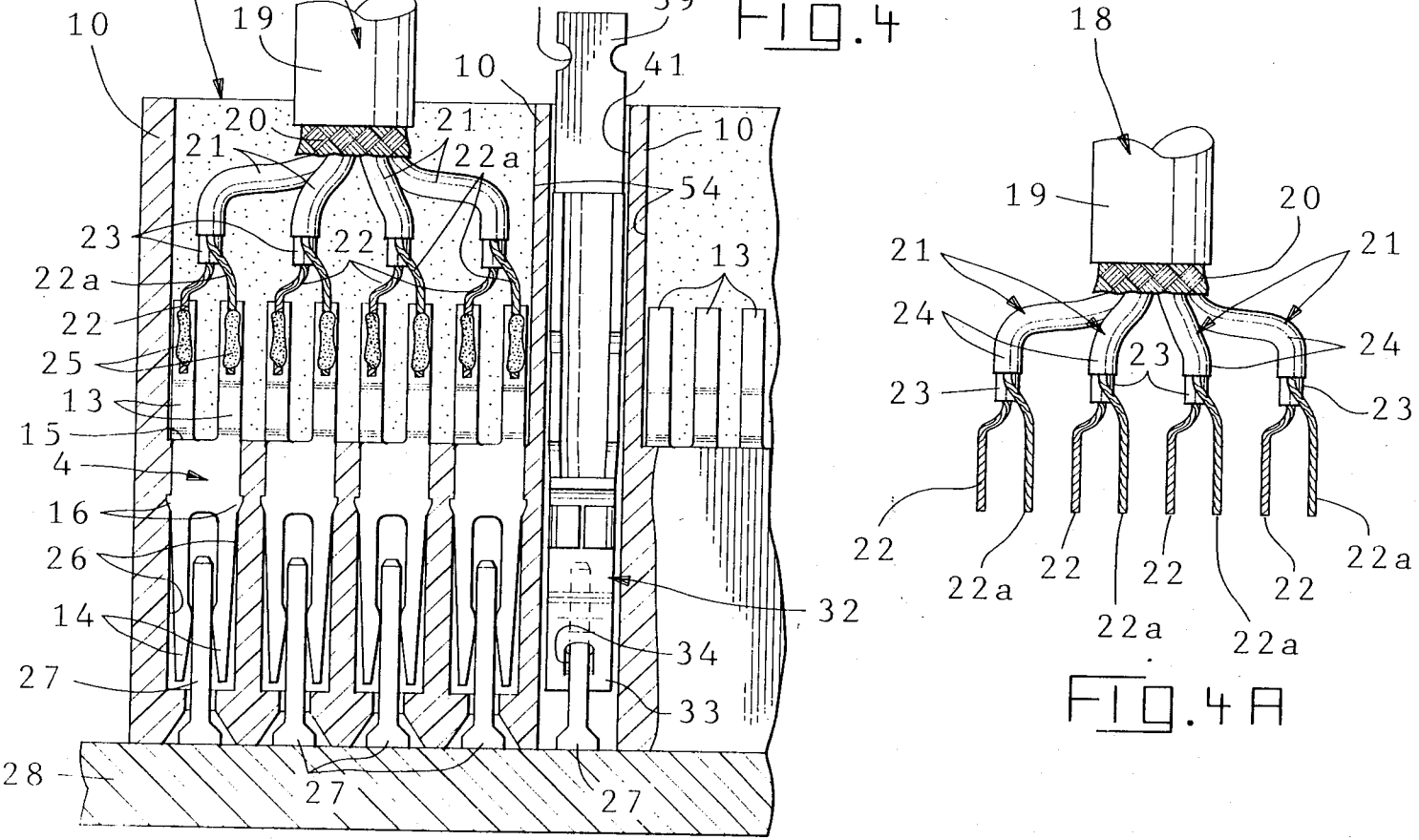
FIG. 4 is an enlarged fragmentary elevation view in section of the electrical connector, as shown in FIG. 1, and illustrating a contact connected to a corresponding pin.
FIG. 4A is an enlarged fragmentary elevation view of a cable of the cable assembly shown in FIG. 1.

With reference to FIGS. 3 and 4, there is shown an exemplary one of the contacts 4,4 stamped out from a strip of metal. The contact 4 is of unitary elongated construction with a central portion 11 connected to an axially extending, elongated electrical receptacle 12 and to an axially extending, elongated, wire connecting tab 13 that is offset laterally from the receptacle 12. For example, the contact 4 is stamped and formed from round gauge or square gauge wire, with the thickness of the tab 13 in one plane and the thickness of the receptacle 12 in a plane transverse to the one plane. The receptacle 12 includes a pair of spring fingers 14,14 spaced apart to define a pin receiving passage between the fingers 14,14. The central portion 11 of the contact 4 includes a rear facing transverse shoulder 15 axially aligned with the receptacle 12 and a corresponding wedge 16,16 on each lateral side 17,17.

An electrical cable 18 as shown in FIG. 4A comprises an outer insulative jacket 19 encircling a conductive sheath 20 that is typically a layer of braided wires encircling a layer of conductive film. The conductive sheath 20 encircles four individual coaxial conductors 21,21. Each coaxial conductor 21 includes a central, signal carrying wire 22 concentrically encircled by a layer of insulation 23, in turn, concentrically encircled by a conductive film 24, for example, in the form of a conductive foil, in turn, encircled by and engaged by the sheath 20. Each coaxial conductor 21 includes a conductive drain wire 21*a*, for connection to ground electrical potential, encircled by and engaging the conductive film 24.

As shown in FIG. 4, the various parts of the cable 18 are cut to different lengths. Each layer of insulation 23 projects from cut ends of the sheath 20 and the jacket 19. Each wire 22,22*a* projects from a cut end of a layer of insulation 23 and is connected to a corresponding tab 13,13 by a welded connection shown by a weldament 25,25.

With reference to FIG. 4, each contact 4 is assembled in a corresponding cavity 3 of the housing 2 with the shoulder 15 providing a surface against which force is exerted to drive the contact 4 into the corresponding cavity 3. The contact 4 is moved along the cavity 3 until the shoulder 15 is coplanar with the rear end of the block 8. For example, a ram, not shown, imparts force against the shoulder 15 until the movement of the ram is stopped by the rear end of the block 8. The wedges 16,16 penetrate opposite facing axially extending interior walls 26,26 of the cavity 3, and are locked in fixed position against the walls 26,26. The corresponding wires 22,22,22*a*,22*a* connected to the contacts 4,4 project into a space between the rear walls 10,10 of the housing 2. The contacts 4 connected to corresponding signal carrying conductors 22 are assembled in corresponding cavities 3 located in a first row. The contacts 4 connected to corresponding drain wires 21*a* are assembled in corresponding cavities 3 in another row, parallel to the first row. The cut ends of the cable jacket 19 and the sheath 20 project into the space between the rear walls 10,10 of the housing 2. The mass 6 of insulative material, in solidifiable form, is cast in place, between the rear walls 10,10 of the housing 2. The solidified mass 6 of insulative material adheres to a rear end of the block 8, and to the wires 22,22 and the cable jacket 19 and the sheath 20 that are imbedded in the mass 6 of insulative material.

The fingers 14,14 of the receptacle 12 receive and conductively engage a corresponding conductive pin 27 projecting from a printed circuit board 28. As shown in FIG. 1 the pin 27 is one of a plurality of like pins 27,27 closely spaced apart and projecting from the printed circuit board 28. The housing 2 is constructed to fit among the pins 27,27 for connecting the contacts 4,4 in the housing 2 to corresponding pins 27,27. Further, the connector 1 fits among a plurality of like connectors 1 for connection to corresponding said pins 27,27. Insulative headers 29,29 are mounted to the printed circuit board 28 to align corresponding connectors 1,1 on the printed circuit board 28. Corresponding connectors 1,1 are inserted into the headers 29,29. A projecting key 30 on the corresponding connector 1 is slidably received along a keyway 31 in the header 29.

Figure 5:
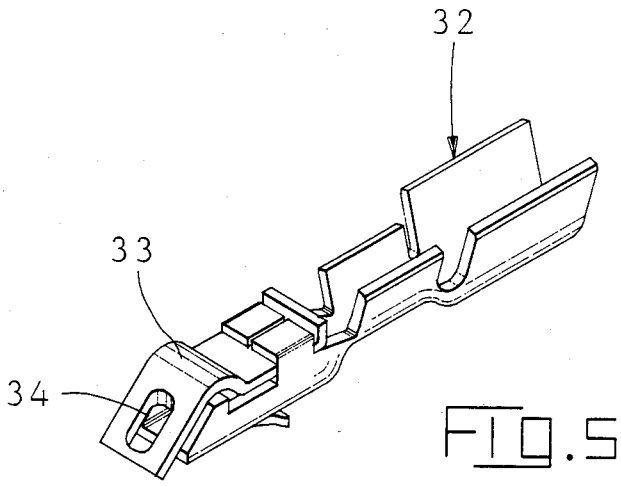
FIG. 5 is an enlarged perspective view of a conductive locking member of the cable assembly shown in FIG. 1.

With reference to FIG. 5, there is shown a conductive locking member 32 described in further detail according to the disclosure of U.S. Pat. No. 3,796,987 incorporated herein by reference. According to that disclosure, the conductive locking member 32 includes a spring 33 with an aperture 34 for receiving a corresponding pin 27. The spring 33 is constructed for locked engagement on the pin 27, and is unlocked from the pin 27 upon deflection of the spring 33 away from the pin 27.

Figure 6:
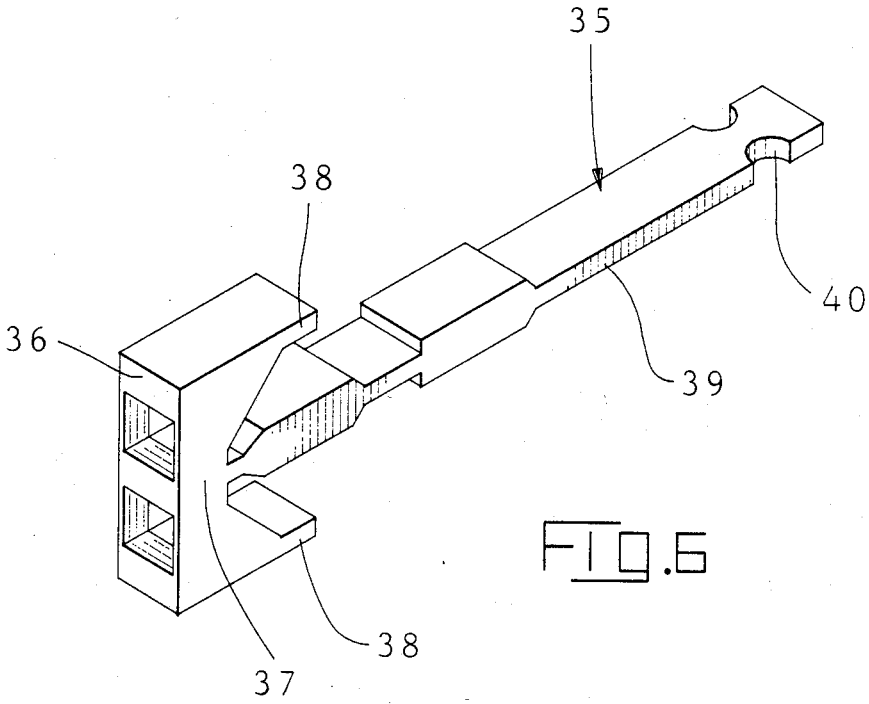
FIG. 6 is an enlarged perspective view of a movable housing of the cable assembly shown in FIG. 1.
Figure 7:
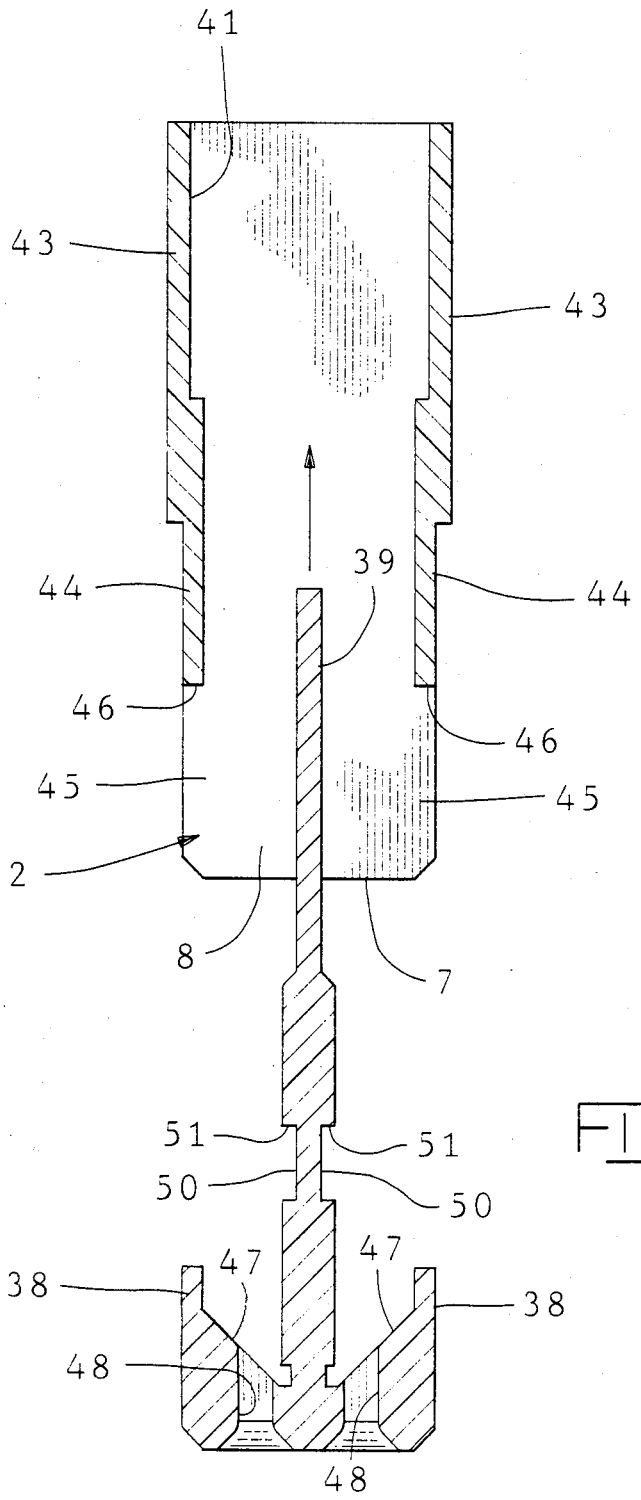
FIG. 7 is an enlarged elevation view in section of the movable housing shown in FIG. 6 and the insulative housing shown in FIG. 2.

FIGS. 6 and 7 disclose a unitary insulative movable housing 35 having a front end 36 with a transverse wall 37 intersecting exterior, axially extending, side walls 38,38 and an axially extending central wall 39 spaced laterally apart from and between the side walls 38,38. The central wall 39 includes an elongated and rearward projecting handle. The end of the handle 40 is provided with neck 40 of reduced circumference to which may be secured a lanyard, not shown.

As shown in FIGS. 2, 4, 7 and 8, the insulative housing 1 includes a pair of axial passages 41,41 along tubular portions 42,42 defined between corresponding spaced apart rear walls 10,10 and spaced apart exterior side walls 43,43 of the housing 2 connected to and extending between the corresponding spaced apart rear walls 10,10. Each passage 41 extends axially through the block 8 to the front end 7. Sides 44 and the front end 7 of the block 8 are provided with corresponding recesses 45,45 communicating with corresponding passages 41,41 and ending in transverse, front facing shoulders 46,46.

A movable housing 35 is mounted for movement axially along a corresponding passage 41. The central wall 39 of the movable housing extends axially along a corresponding passage 41. The side walls 38,38 of the movable housing 35 are received for movement axially along corresponding recesses 45,45 of the block 8 and face corresponding shoulders 46,46 of the block 8. The side walls 38,38 engage the shoulders 46,46 to limit movement of the movable housing 35 in a rearward direction.

Locking member receiving cavities are defined along each passage 41 at either side of the central wall 39 of the movable housing 35. The locking members 32,32 are received in corresponding cavities. Each cavity includes an inclined interior end wall 47 of a corresponding movable housing 35 intersected by a corresponding pin receiving opening 48. Each cavity is adjacent a corresponding side wall 38 of the movable housing 35.

Figure 8:
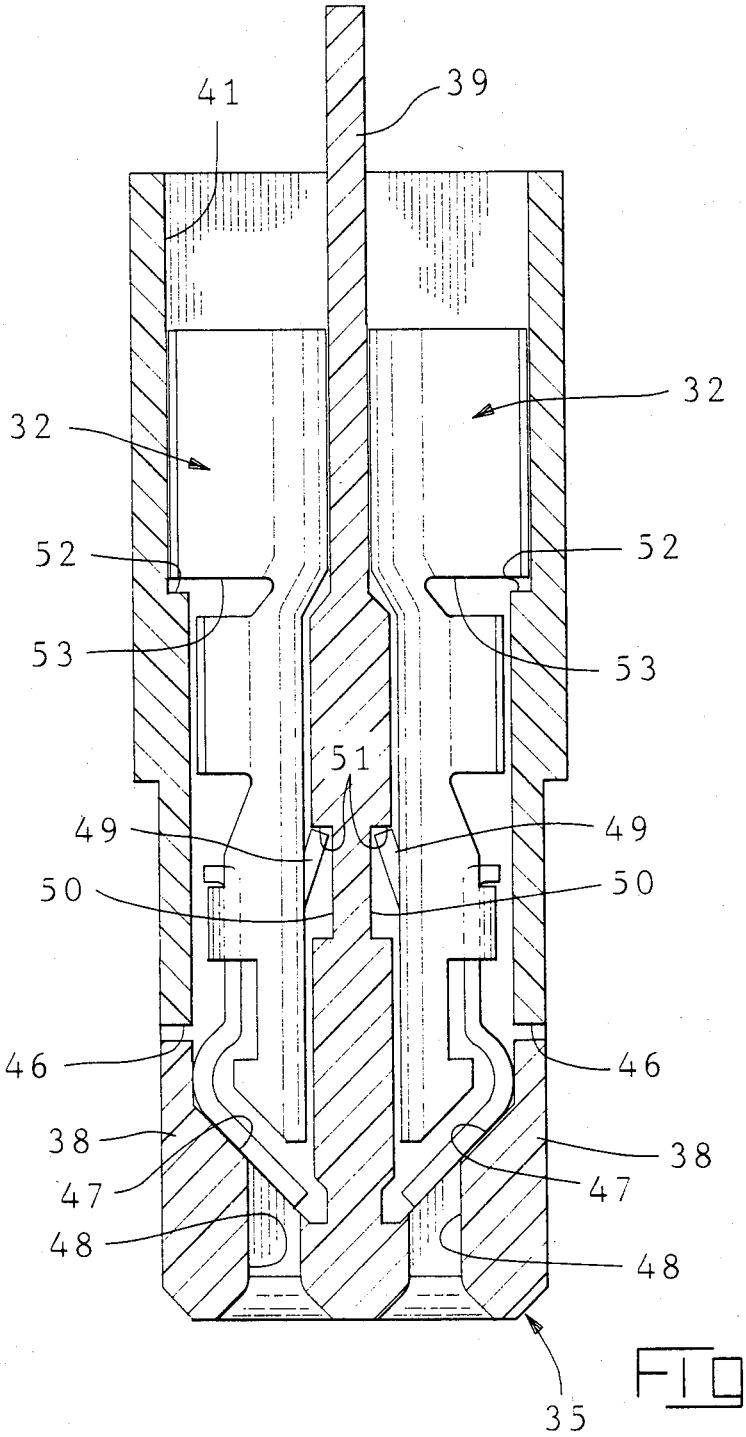
FIG. 8 is an enlarged elevation view in section of the movable housing and the locking members assembled with the insulative housing as shown in FIG. 2.

As shown in FIG. 8, each conductive locking member 32 is locked to the insulative housing 1 and to the movable housing 35 by the following structure. A locking tab 49 projects outwardly of each conductive locking member 32 and is received in a corresponding recess 50 laterally in the central wall 39. The locking tab 49 engages a front facing shoulder 51 of a corresponding recess 50 to limit movement of the movable housing 35 toward the front of the connector 1, and to limit movement of the conductive locking member toward a rear of the connector 1. A rear facing shoulder 52 on each rearward side wall of the insulative housing faces a front facing shoulder 53 on a corresponding conductive locking member 32 to limit movement of the conductive locking member 32 toward the front of the connector 1. As shown, it is not necessary that the locking members 32,32 connect to a corresponding cable 5. If desired, the locking members 32,32 can be connected to a corresponding cable 5 before the locking members 32,32 are assembled in the cavities.

The handle 39 of the movable housing 35 extends axially and rearwardly of the passage 41 and through an opening 54 in the mass 6 of insulative material. Thereby the handle 39 is readily available for being grasped and pulled to displace the movable housing 35 in a direction rearwardly of the insulative housing 2 and to deflect the locking members 32,32 and unlock them from corresponding pins 27,27.

When a connector 1 is connected to corresponding pins 27,27, each locking member 32 will releasably lock to a pin 27 received through its aperture 34. To disconnect the connector 1 from the pins 27,27, a tensile force is applied on the handle 39 to urge the movable housing 35 against the spring 33 of each locking member 32. Each inclined wall 47 of the movable housing 35 will deflect a corresponding spring 33 away from the pin 27, to unlock the locking member 32 from the pin 27. Once the locking members 32,32 are unlocked from the pins 27,27, further tensile force on the handle 39 will cause the contacts 11,11 to be slidably withdrawn from engagement with the corresponding pins 27,27 and the connector 1 to be withdrawn from header 29 and the printed circuit board 28.

We claim:

1. In an electrical connector comprising; locking members constructed for locking to conductive pins projecting from a printed circuit board, an insulative housing containing the conductive locking members and a movable housing for movement against the locking members to deflect the locking members to unlock them from the pins, the improvement comprising; electrical contacts in the insulative housing for unlocked connection to corresponding said conductive pins, the locking members are mounted in the movable housing, the movable housing is mounted for axial movement within the insulative housing, and the insulative housing contains the movable housing and is adapted to fit among a plurality of like connectors for connection to closely spaced apart pins projecting from a printed circuit board.

2. In an electrical connector as recited in claim 1, the improvement further comprising; a handle portion of the movable housing projecting rearwardly of the insulative housing.

3. In an electrical connector as recited in claim 1, the improvement further comprising; walls of the insulative housing and defining a passage receiving the movable housing, and a mass of insulative material adhered to said walls and to a rear end of the insulative housing.

4. In an electrical connector as recited in claim 1, the improvement further comprising; a recess in a front end of the insulative housing receiving a front end of the movable housing, an axially extending passage communicating with the recess and encircling the movable housing.

* * * * *